United States Patent [19]

Tomov

[11] 4,452,126

[45] Jun. 5, 1984

[54] PNEUMATIC DRIVE

[76] Inventor: Mitko Tomov, Moosacher Strasse 75, Munich 40, Fed. Rep. of Germany

[21] Appl. No.: 366,839

[22] Filed: Apr. 9, 1982

[30] Foreign Application Priority Data

May 5, 1981 [DE] Fed. Rep. of Germany ..... 3117740

[51] Int. Cl.[3] ..... F01B 21/02

[52] U.S. Cl. ..... 92/6 R; 92/50; 92/169; 92/177; 123/193 P

[58] Field of Search ..... 92/6 D, 6 R, 89, 50, 92/75, 69 R, 177, 201, 169, 94, 60.5, 120; 123/193 R, 193 P, 48 R, 78 R

[56] References Cited

U.S. PATENT DOCUMENTS

| | | | |
|---|---|---|---|
| 2,710,077 | 1/1952 | Fabel et al. | 92/177 |
| 2,800,270 | 7/1957 | Petersen | 92/75 |
| 2,979,032 | 4/1961 | Engquist et al. | 92/75 |
| 2,989,227 | 6/1961 | Statham | 92/6 |
| 3,862,590 | 1/1975 | Mengeler | 92/169 |
| 3,908,512 | 9/1975 | Strubin | 92/6 R |
| 4,118,152 | 10/1978 | Bron | 92/60.5 |

FOREIGN PATENT DOCUMENTS

| | | | |
|---|---|---|---|
| 53139216 | 5/1980 | Japan | 92/6 R |

*Primary Examiner*—Robert E. Garrett
*Assistant Examiner*—Scott L. Moritz
*Attorney, Agent, or Firm*—Peter K. Kontler

[57] ABSTRACT

A pneumatic drive has at least one working cylinder composed of a pair of parallel stationary walls and a pair of walls which extend at right angles to the first pair and are movable relative thereto, towards and away from each other. This varies the volumetric content of the cylinder and changes one transverse dimension thereof. A piston is reciprocable in the cylinder and constructed of a plurality of sections which together define the piston surface that is exposed to the pressurized working medium of the drive. During the working stroke these sections move apart from one another so as to together define a piston surface of maximum area; during the idle (return) stroke the sections are moved together by an arrangement provided for this purpose, so that some of them are concealed behind or within others, thus reducing the piston surface to an area which may only amount to about 20% of the former area.

11 Claims, 6 Drawing Figures

PNEUMATIC DRIVE

BACKGROUND OF THE INVENTION

The present invention relates to a drive.

More particularly, the invention relates to a pneumatic drive (motor).

Still more specifically, the invention herein disclosed relates to a pneumatic drive having a variable-surface working piston.

In recent years the costs of operating many of the long-established types of drive mechanisms have been subject to strong upward pressures. A prime example of this is, of course, the steady price increase of fuel for internal combustion engines. In view of these developments, serious efforts are being made to develop alternative power sources to combat both the rising cost and the scarcity of fuel for the more conventional types.

A potentially attractive alternative is the field of pneumatic drives. These, however, as known from the prior art are subject to two disqualifying drawbacks: they are not adequately efficient and they waste a great deal of compressed air which is discharged to the atmosphere and must be replenished with the expenditure of expensive fuel. For these reasons, pneumatic drives have to date not been able to make any serious impact as a replacement for more conventional (e.g. gasoline-powered) drive arrangements.

OBJECTS AND SUMMARY OF THE INVENTION

Accordingly, it is an object of the present invention to overcome the disadvantages of the prior art.

a more particular object of the invention is to provide a pneumatic drive of drastically increased efficiency.

Another object is to provide a drive of the kind under discussion, in which the use (and waste) of compressed air is greatly reduced.

A concomitant object is to provide such a drive as discussed hereinbefore, which is of relatively simple construction and which is reliable in its operation.

In keeping with these objects and with still others which will become apparent as the description proceeds, one aspect of the invention resides in the provision of a pneumatic drive which, briefly stated, may comprise first means defining at least one working cylinder having an interior adapted to receive a pressure medium; and second means defining in the interior a working piston which is reciprocable to perform a working stroke during which it exposes a first piston surface area to the pressure medium, and an idle stroke during which it exposes a smaller second piston surface area to the pressure medium.

The efficiency of the drive according to the present invention is greatly increased over that known from the prior-art pneumatic drives. One of the main reasons for this is that during its working stroke the piston presents a maximum surface area to the pressure medium, whereas during its (non-productive) idle stroke the piston has a minimum surface area which is much smaller, e.g. on the order of only 20% of the maximum surface area. It stands to reason that this differential makes for drastically increased efficiency of the drive according to the present invention, as compared to the nonadjustable pistons of the prior art. The novel features which are considered to be characteristic of the invention are set forth in particular in the appended claims. The improved device itself, however, both as to its construction and mode of operation, as well as additional features and advantages thereof, will be best understood upon a perusal of the following detailed description of specific although purely exemplary embodiments with reference to the accompanying drawing.

DESCRIPTION OF PREFERRED EMBODIMENTS

Figure 1:
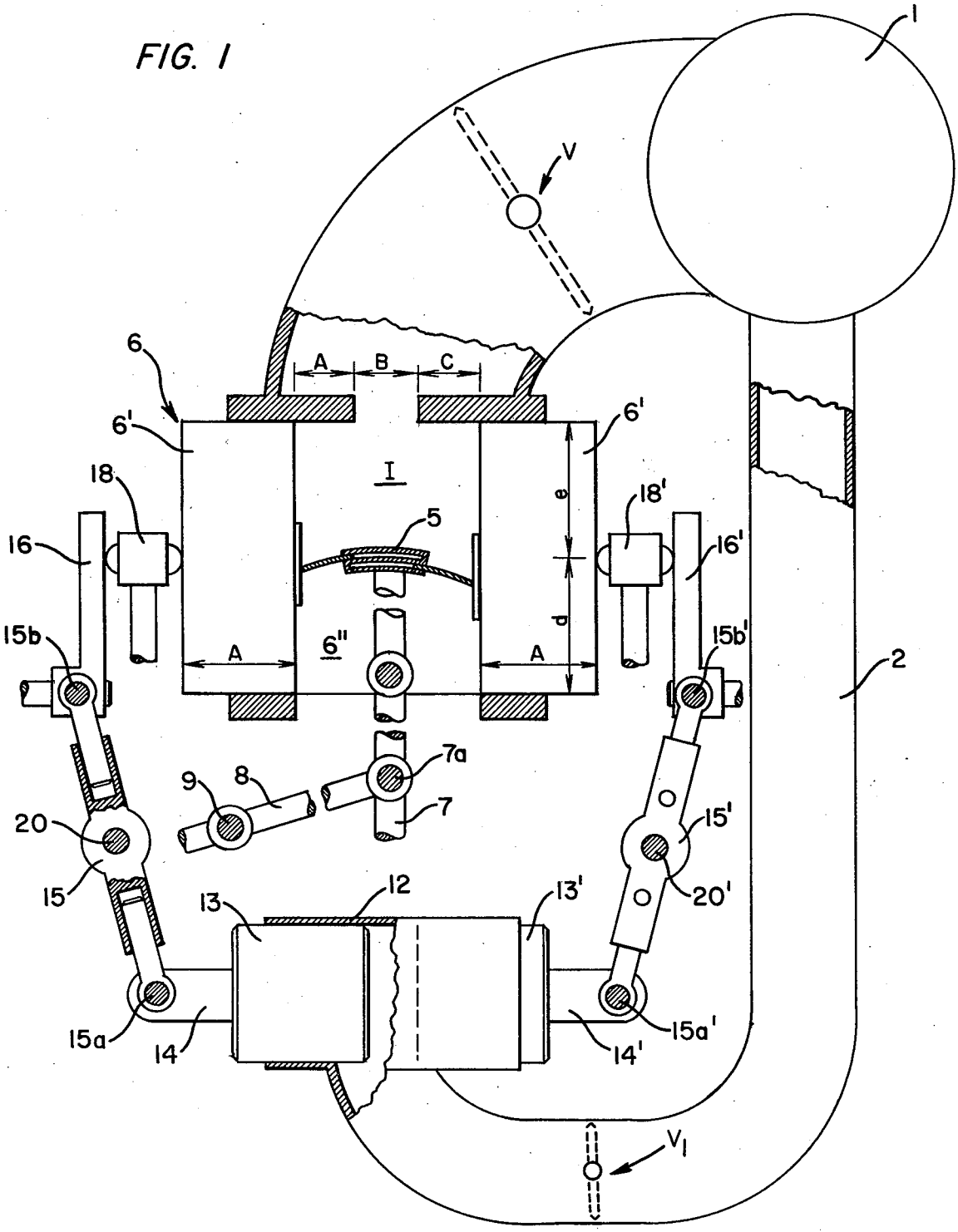
FIG. 1 is a somewhat diagrammatic illustration, showing a pneumatic drive according to the invention in its starting (upper dead center) position with the piston exposing a maximum piston surface area.

An embodiment of the drive according to the present invention is illustrated in FIGS. 1–4, which should be jointly considered.

The energy for operating the pneumatic drive is supplied by compressed gas (generally air) contained in a reservoir 1. The drive has a working cylinder 6 which will be described in more detail below, and the volume ratio of reservoir 1 to working cylinder 6 is preferably (but not necessarily) on the order of 100:1. The working medium is stored in reservoir 1 at an appropriate pressure, for which a level of about 30 bar has been found to be well suited.

The working cylinder 6 is of angular rather than circular cross-section and has a first set of two opposed—and movable—walls 6', 6' and a second set of walls (only wall 6'' visible because of where the section line is taken) which extend at right angles to the two walls 6'. The walls 6' are able to slide towards and away from one another, as indicated by the double-headed arrows A in FIG. 1. Of course, there must be appropriate seals at the junctures between the movable walls 6' and the (stationary) walls 6'' which extend at right angles to them; however, such seals (e.g. elastomeric lip seals or the like) are known per se and require no detailed discussion herein. In any event, these four walls define the interior I of the working cylinder 6 and the volume of this interior is evidently variable in view of the mobility of the walls 6'. The interior I is connectable to—and disconnectable from—the reservoir 1 by any valve (see the valve V in FIG. 1).

Arranged for reciprocation (vertically in FIGS. 1–4) within the cylinder 6 is a working piston 5 having a variable-area piston surface, details of which will be explained below. A piston rod 7 is connected to the piston 5 and extends out of the lower end of cylinder 6. A lever 8 is articulately connected to piston rod 7 at 7*a* and is in turn pivotable about the axis of a pivot 9; the free end (not shown) of lever 8 is connected to a flywheel or the like, to convert the reciprocatory movement of piston 5 in known-per-se manner into a rotary movement.

Figure 2:
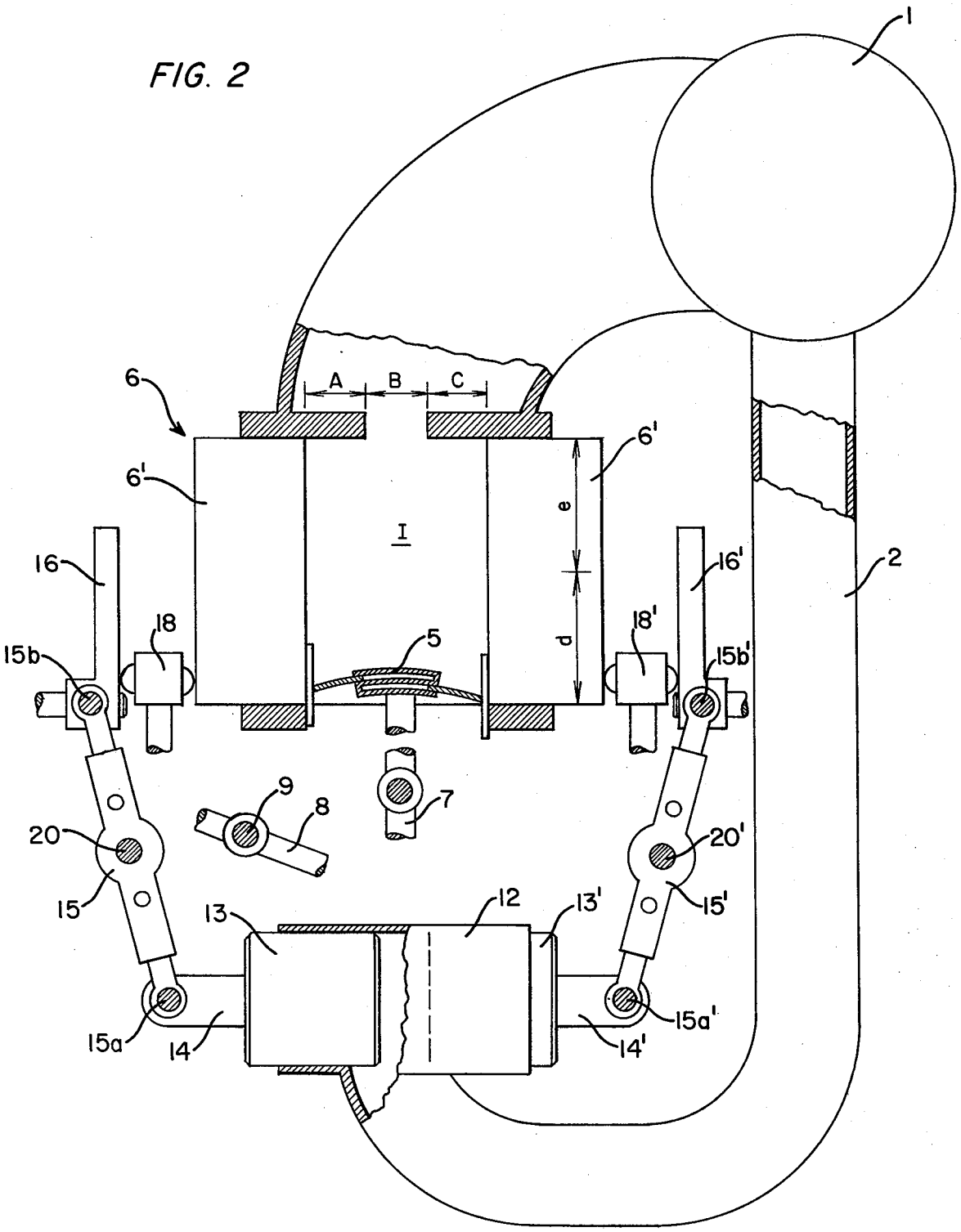
FIG. 2 is similar to FIG. 1, but shows the piston (with the same maximum piston area) in its lower dead center position, i.e. at the end of its working stroke.

FIG. 1 shows the arrangement with the piston 5 in its top dead center position in which the piston center is located at—or substantially at—the midpoint between the two ends of cylinder 6. This is symbolized in the drawing by the fact that the two distances d and e are of equal magnitude. In FIG. 1 the piston 5 is at the beginning of its working stroke and exposes a maximum piston surface area to the working medium entering the interior I from the reservoir 1. In FIG. 2 the piston 5 has reached the end of its working stroke but its surface area has not yet been reduced from the maximum area.

Figure 3:
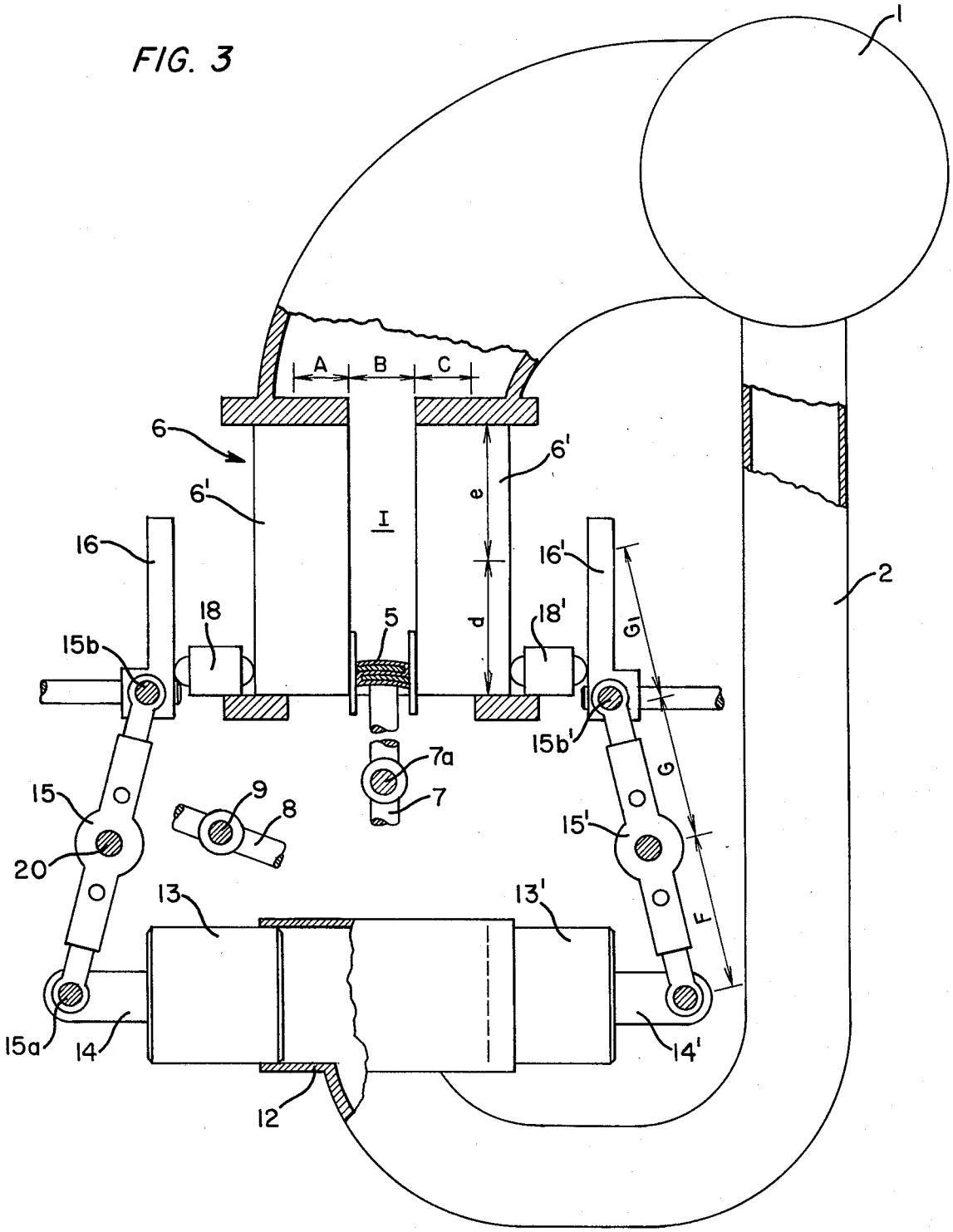
FIG. 3 is analogous to FIG. 2, but shows the piston in its lower dead center position in readiness for the idle (return) stroke and with its piston surface area reduced to a minimum size.
Figure 4:
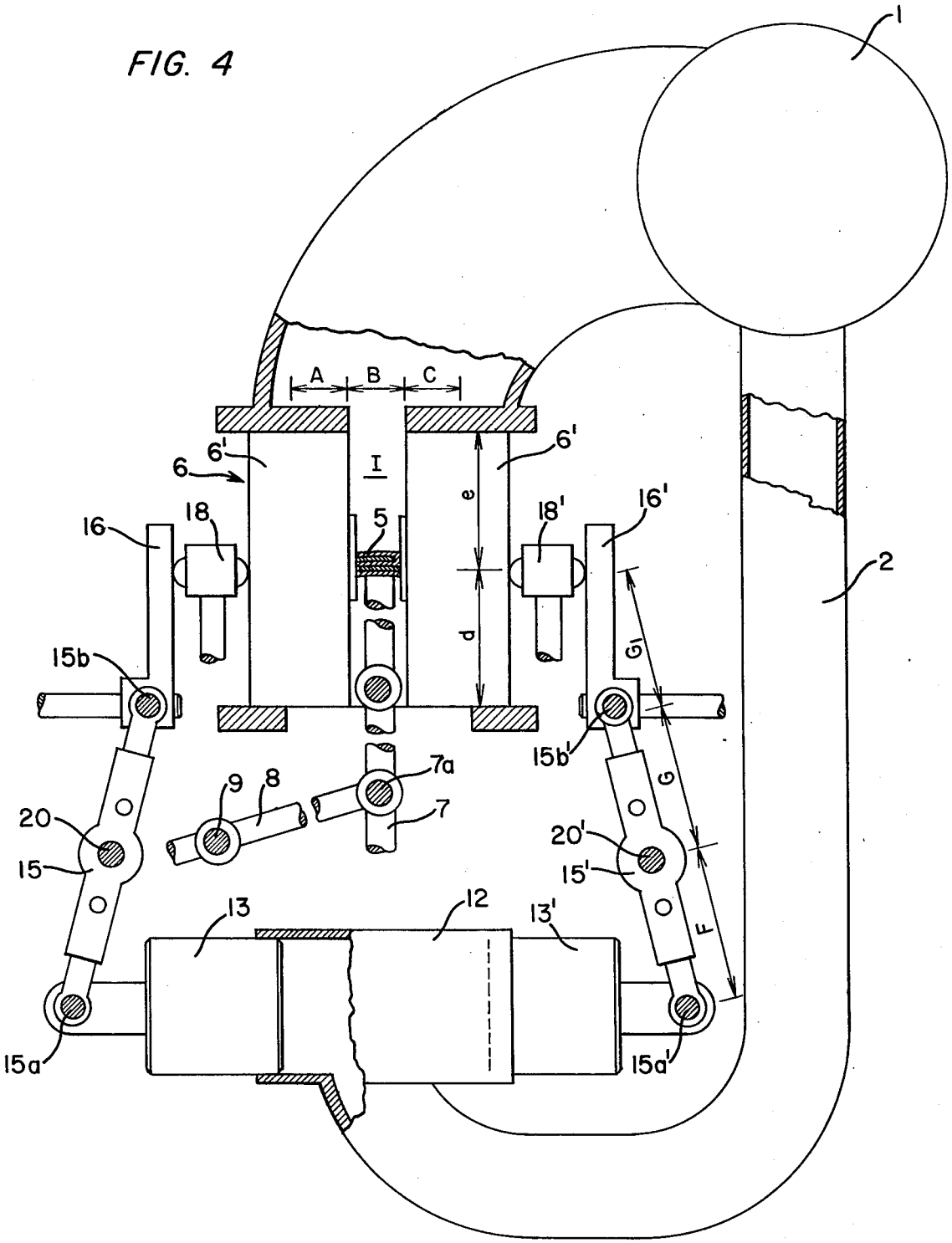
FIG. 4 is similar to FIG. 3, but shows the piston at the end of its idle stroke (i.e. in the upper dead center position) and with its piston surface area still reduced as in FIG. 3.

To effect this reduction from the position shown in FIGS. 1 and 2 (in which the maximum working width of piston 5 and the maximum interior dimensions of cylinder 6 equal the combined distances A+B+C) to the position shown in FIGS. 3 and 4 (in which the maximum working width of piston 5 and the maximum interior dimension of cylinder 6 equals only the distance B), the walls 6', 6' of cylinder 6 are moved towards one another. For this purpose an actuating cylinder 12 is provided in which two pistons 13, 13' are movable in opposite directions. The center of cylinder 12 (i.e. the space between the juxtaposed end faces of the pistons 13,13') is connected to the reservoir 1 via a conduit 2 so that the pressure conditions prevailing in reservoir 1, conduit 2, cylinder 12 and cylinder 6 are at all times identical or substantially so. A conventional valve V, (see FIG. 1) is interposed between reservoir 1 and cylinder 12, so as to establish and interrupt the supply of pressure medium to this cylinder. The pistons 13, 13' have piston rods 14, 14' and to the free ends of these latter there are articulately connected at 15*a*, 15*a'* two two-armed levers 15 and 15', respectively, which are displaceable about the axes of pivots 20 and 20'. The upper (free) ends of the levers 15, 15' (which levers, incidentally, may be telescopically length-adjustable as shown in connection with lever 15 in FIG. 1), are articulately connected at 15*b*, 15*b'* to respective flanges (pressure-transmitting members) 16, 16'. These flanges 16, 16' are movable in the same directions as indicated by the double-headed arrows A. When moving towards one another, the flanges 16, 16' transmit pressure to the walls 6', 6' via interposed force-transmitting members 18, 18'. These, in turn, are connected to the piston rod 7 in such a manner that they reciprocate in synchronism with the piston 5, i.e. they participate in the working and idle strokes of the piston. Preferably, the members 18, 18' are connected by suitable means to the pivot 7*a*.

Turning now to FIGS. 3 and 4 it will be seen that after piston 5 has completed its working stroke (i.e. after it has moved from the top dead center position of FIG. 1 to the bottom dead center position of FIG. 2), the two movable walls 6', 6' are shifted to the positions shown in FIGS. 3 and 4, utilizing the arrangement described above. It should be noted that, as indicated in FIGS. 3 and 4, the lever arms F and G of the levers 15, 15' are of identical length and that the distance $G_1$ (which corresponds to the stroke d of piston 5) equals the length G. Hence, the combined length $G+G_1$ (see FIG. 4) is twice as long as the lever arm F. This relationship is not to be considered an absolute value; however, it has been chosen to assure that sufficient force is always available to shift the walls 6', 6' towards one another whenever required.

It will be appreciated from the drawing that the movements of the walls 6', 6' and pistons 13, 13' are mutually opposite; which is to say that when walls 6', 6' move towards one another the pistons 13, 13' move apart, and vice versa. The surfaces of pistons 13, 13', the walls 6', 6' and the levers 15, 15' are of course so dimensioned (empirically, if necessary) that the forces acting from both pistons 13, 13' upon the walls 6', 6; are of identical (or at least substantially identical) magnitude, to assure that during movement of the walls 6', 6' it is essentially only frictional forces that need to be overcome. Due to the fact that the ratio of reservoir 1 to cylinders 6 and 12 has been selected rather high, the volume changes which take place in the system due to movement of the walls 6', 6' have practically no effect on the pressure (e.g. 30 bar as mentioned) prevailing in the reservoir 1.

The reduction in the piston surface area from maximum (FIGS. 1 and 2) to minimum value (FIGS. 3 and 4) takes place concomitantly with the movement of the walls 6', 6' towards one another—and under the inward pressure exerted by these walls. Conversely, when the walls 6', 6' move apart again (to the positions of FIGS. 1 and 2) the piston surface area is increased again to the maximum under the influence of pressure medium entering the interior I from the reservoir 1, in that the pressure medium pushes the walls 6', 6' apart from one another until they reach the positions shown in FIGS. 1 and 2. It is to be noted, as already briefly indicated above, that since both of the cylinders 6 and 12 are subject to the same medium pressure, the force required to effect these movements of the walls is essentially only that force needed to overcome friction.

To initiate the pivoting of the levers 15, 15' from the positions shown in FIGS. 1 and 2 to the positions shown in FIGS. 3 and 4, an arrangement can be provided (not illustrated) which is controlled by the movement of the piston rod 7 in order to urge the levers 15, 15' in the required direction so as to overcome a possible still-stand due to a balanced position condition. Return of the piston 5 from the bottom dead center position (FIG. 4) with the piston surface at a minimum so as to expose as little surface as possible to the pressure medium, is effected—in a multi-cylinder motor—with the aid of energy supplied by one or more adjacent cylinders; if necessary or desired, flywheels or other known-per-se instrumentalities may be suitably interposed. In the mere theoretic event that the motor has only a single cylinder 6, some additional external force may need to be applied to effect the return stroke of piston 5 from the position of FIG. 3 to that of FIG. 4, for example, an electrically driven crank or cam means for effecting the idle stroke of the piston 5.

In any event it is clear that, since the piston 5 has a much smaller surface area when it performs its idle stroke (from the position shown in FIG. 3 to that shown in FIG. 4) than when it performs its working stroke (from the position shown in FIG. 1 to that shown in FIG. 2), much smaller forces are required to move the piston 5 to peform its idle stroke. In other words: the forces needed to move the piston 5 from the position of FIG. 3 to the position of FIG. 4 are quite dramatically smaller than the usable forces which are produced during the working stroke when the piston 5—with its surface area set for maximum exposure—moves from the position of FIG. 1 to the position of FIG. 2. In this connection it is emphasized once again that the force required for shifting of the walls 6', 6' from the positions shown in FIGS. 1–2 position to the positions shown in FIGS. 3–4 is essentially only that force which is needed to overcome the sliding friction of these walls, since the identical medium pressure prevails in the two cylinders 6 and 12 and since appropriate dimensioning assures that the cylinder 6 and its walls 6', 6' are in a state of equilibrium with the cylinder 12 and its pistons 13, 13'.

The variable-surface piston 5 may be constructed in a variety of different ways. Two currently preferred embodiments of suitable pistons are illustrated in FIGS. 5A and 5B.

Figure 5A:
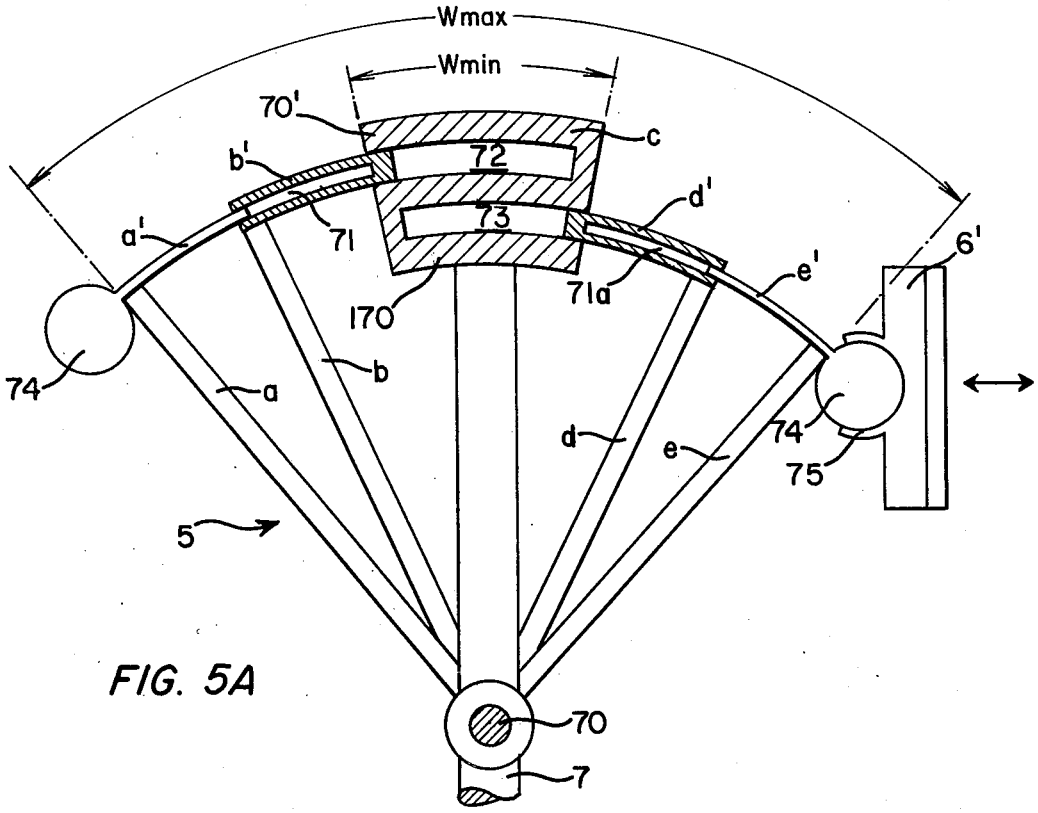
FIG. 5*a* is a diagrammatic side elevation, partly in section, of one embodiment of a piston for use in the inventive novel drive.

According to FIG. 5A the piston 5 (seen in the same direction as in FIGS. 1–4) is composed of a plurality of sections, rods, spokes or the like which are identified by reference characters a, b, d and e and which respectively have upper end portions a', b', d', and e' that are elongated in direction normal to the plane of FIG. 5A. These sections a, b, d and e each have one end articulately at 70 to the piston rod 7. Carried by the (inner) free end of piston rod 7 is a center element c having wall portions 70, 70' which respectively define interior spaces 73, 72 that are accessible from mutually opposite sides. The free ends of the upper end portions b' and d' can telescope into and out of the spaces 72 and 73, respectively. In turn these end portions b' and d' are sufficiently hollow so that, at their sides facing away from the center element c, their recesses 71, 71*a* can receive the free ends of sections a' and e' which are thus enabled to telescope into and out of the sections b' and d'. It follows, then, that in the position which the piston 5 assumes for its working stroke (i.e. the position shown in FIGS. 1–2), the piston surface area exposed to the pressure medium equals the dimension $W_{max}$ shown in FIG. 5A. Conversely, when the piston is collapsed (i.e. has its surface area reduced to the minimum for the idle stroke (compare FIGS. 3–4), the piston surface area exposed and to be moved against the opposition of to the pressure medium equals the (much smaller) dimension $W_{min}$. Since the sections a', b', d', e' and element c in FIG. 5A are of identical dimensions in the plane of FIG. 5A, and there are five of them of which four are telescopable in the illustrated manner, the dimension $W_{min}$ will be equal to one-fifth of the dimension $W_{max}$; which is to say that for the idle (return) stroke the piston surface area which needs to be moved against the opposition of the pressure medium is reduced to a mere fifth of the piston surface area which is exposed to the thrust of the pressure medium during the working stroke.

Figure 5B:
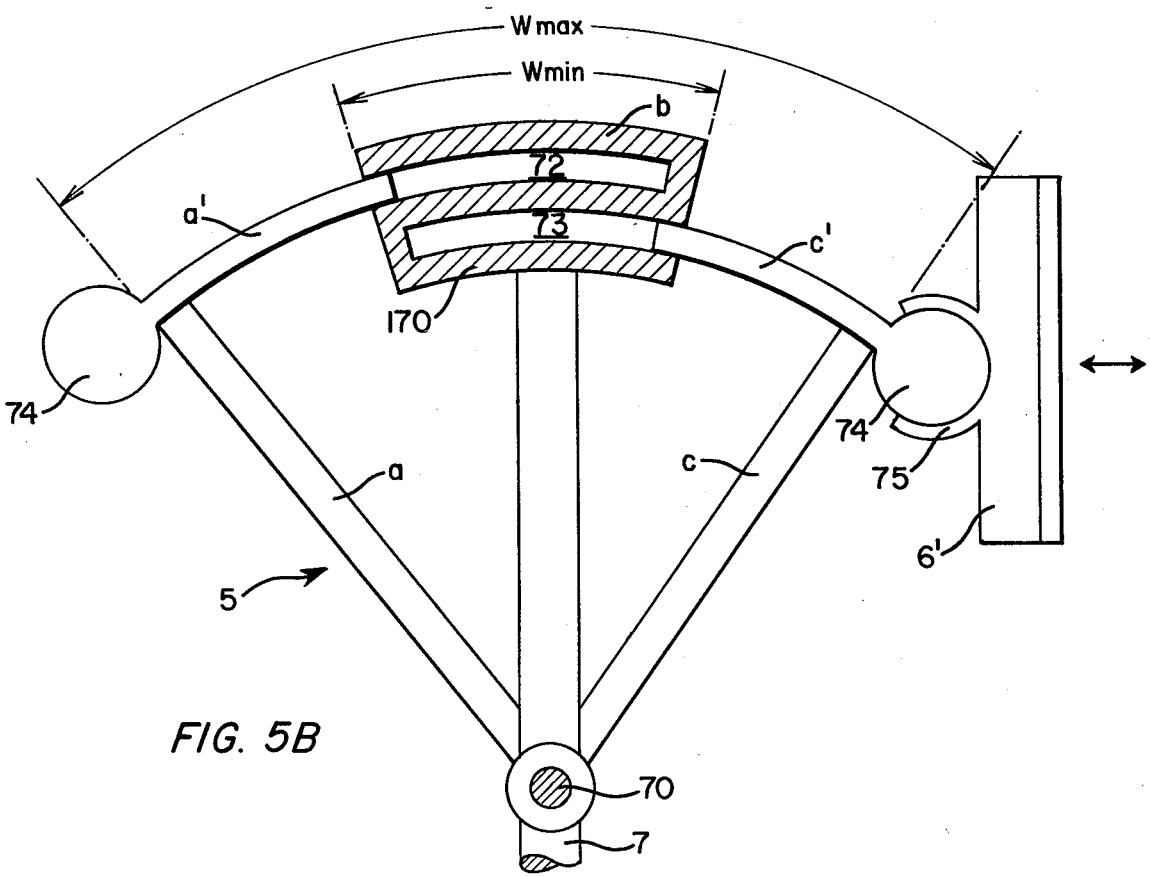
FIG. 5*b* is a view analogous to FIG. 5*a*, but showing a different embodiment of a piston for use in the inventive novel drive.

The embodiment of FIG. 5B is similar to that of FIG. 5A, except that in addition to the center element or section b carried by the free end of piston rod 7, there are only two additional sections a and c which are again articulately connected to the piston rod at 70. Center section b again has two interior spaces 72, 73 into which the free ends of the upper end portions a' and c' of sections a and c telescope from opposite sides, as shown. Since the sections a, b and c are of identical dimensions in the plane of FIG. 5B, and since there are three of them of which two telescope into and out of the third one, it follows that the piston surface area exposed to the pressure medium can vary between the dimension $W_{max}$ and a dimension $W_{min}$ which equals one-third of the dimension $W_{max}$.

FIGS. 5A and 5B both show (at the right-hand side) one of the shiftable walls 6' of the (otherwise not illustrated) working cylinder 6. Each of these walls has a socket 75 or similar connection with which a formation 74 of the piston 5 is connected; the elements 74 and 75 cooperate to produce a reliable and gas-tight connection between piston surface and wall 6'. It goes without saying, of course, that a similar connection is established with the other (not illustrated) movable wall 6'.

An important aspect of the invention—in addition to the variable-area piston surface and the advantages obtained thereby—is the fact that, contrary to the prior-art pneumatic motors, the novel motor does not vent the pressure medium used for filling the working cylinder 6. On the contrary, instead of discharging this pressure medium into the ambient atmosphere once it has driven the piston to the bottom dead center position (see FIG. 2), the invention provides for the transfer of all or most of this pressure medium into the actuating cylinder 12. This means that the novel motor operates with the consumption of only an exceedingly small quantity of pressure medium for each operating cycle. To the extent that pressure drops in the system due to medium losses, this is easily compensated for by the addition of fresh compressed medium to the reservoir 1. The salient point is that the quantity of such replacement that is needed within a given measuring unit (e.g. per unit time of motor operation) is much smaller than anything known from . the prior art, meaning that the apparatus of the invention is considerably more effective and fuel-efficient than the prior-art devices.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and indeed are intended to be comprehended within the meaning and range of equivalence of the appended claims.

I claim:

1. In a pneumatic drive, a combination comprising first means defining at least one working cylinder having an interior adapted to receive a pressure medium and including a first pair of opposed cylinder side walls and a second pair of opposed cylinder side walls which extend at right angles to said first pair and are movable relative thereto towards and away from one another; and second means defining in said interior a working piston which is reciprocable through a working stroke during which it exposes a first piston surface area to the pressure medium, and an idle stroke during which it exposes a smaller second piston surface area to the pressure medium.

2. A combination as defined in claim 1, and further comprising means connected with said piston and operative for converting the reciprocatory motion thereof into a rotary motion.

3. A combination as defined in claim 1, wherein the walls of said second pair are normal to the walls of said first pair.

4. A combination as defined in claim 1 and further comprising means for effecting movement of the walls of said second pair at least in direction towards one another.

5. A combination as defined to claim 4, said effecting means comprising an actuating cylinder having a pair of oppositely movable actuating pistons, a pair of two-armed levers each mounted for pivoting movement and each having a first end portion pivotally connected to one of said actuating pistons and a second end portion connected with one of the movable walls of said second pair.

6. A combination as defined in claim 5, said levers including means for varying the length of the respective lever arms thereof.

7. A combination as defined in claim 5 and further comprising force-transmitting elements interposed between said second end portions and the respective movable walls of said second pair, said force-transmitting elements being movable in coincidence with the reciprocation of said working piston.

8. A combination as defined in claim 7, said walls of said second pair having outer surfaces, and said force-transmitting elements being arranged to slide on said outer surfaces lengthwise of said interior between two end positions which correspond to a top dead center position and a bottom dead center position assumed by said working piston at the end of its idle stroke and working stroke, respectively.

9. A combination as defined in claim 5, wherein said first piston surface area is reduced to said second piston surface area as a function of pressure exerted by said levers in a sense causing the walls of said second pair to move towards one another and thus to press against said working piston.

10. A combination as defined in claim 1, wherein said second means comprises a plurality of sections each having a surface portion, said surface portions together constituting said piston surface, at least some of said surface portions being prior to execution of said idle stroke movable to positions in which they are at least in part coextensive with others of said surface positions so as to together constitute said smaller second piston surface.

11. A combination as defined in claim 10, one of said sections being a central section which is flanked by the others of said sections, said central section having recesses in which at least portions of at least some of said other sections are telescopically receivable.

* * * * *